US005446269A

United States Patent [19]

Peysakhovich et al.

[11] Patent Number: 5,446,269

[45] Date of Patent: Aug. 29, 1995

[54] TUBING SHAPE, PARTICULARLY FOR FABRICATING AN INDUCTION COIL

[75] Inventors: Vitaly Peysakhovich, Moorestown, N.J.; Oleg S. Fishman, Maple Glen, Pa.

[73] Assignee: Inductotherm Corp., Rancocas, N.J.

[21] Appl. No.: 67,906

[22] Filed: May 27, 1993

[51] Int. Cl.[6] ..... H05B 6/40

[52] U.S. Cl. ..... 219/672; 219/674; 219/677; 373/154; 373/160; 336/62; 336/228

[58] Field of Search ..... 219/677, 674, 672; 373/152, 154, 158, 160, 165; 336/62, 179, 225, 227, 228

[56] References Cited

U.S. PATENT DOCUMENTS

| | | | |
|---|---|---|---|
| 1,683,986 | 8/1925 | Northrup . | |
| 1,795,934 | 9/1927 | Davis et al. . | |
| 1,818,107 | 7/1928 | Taylor . | |
| 1,834,445 | 4/1929 | Brace . | |
| 1,839,801 | 3/1930 | Northrup . | |
| 1,839,802 | 3/1930 | Northrup . | |
| 1,943,802 | 3/1930 | Northrup . | |
| 1,983,242 | 12/1934 | Rohn | 13/27 |
| 2,715,170 | 8/1955 | Sorensen | 219/677 |
| 2,781,437 | 2/1957 | McArthur . | |
| 3,697,914 | 10/1972 | Khrenov et al. | 336/62 |
| 4,622,679 | 11/1986 | Voss | 373/152 |

FOREIGN PATENT DOCUMENTS

| | | | |
|---|---|---|---|
| 570392 | 2/1933 | Germany | 219/674 |
| 3405119 | 8/1985 | Germany . | |
| 53-25940 | 3/1978 | Japan | 219/677 |
| 45963 | 1/1929 | Norway | 219/674 |
| 368541 | 5/1963 | Switzerland . | |
| 390387 | 8/1965 | Switzerland . | |
| 274008 | 7/1927 | United Kingdom . | |
| 861276 | 2/1961 | United Kingdom . | |

*Primary Examiner*—Philip H. Leung
*Attorney, Agent, or Firm*—Seidel Gonda Lavorgna & Monaco

[57] ABSTRACT

Electrically conductive tubing for realizing induction coils having improved efficiencies comprises an outer peripheral portion of conductive material defined by a plurality of side walls and a single hollow passageway. Each side wall has an inner and outer surface. At least one side wall has a curved outer surface. The hollow passageway is defined by the inner surfaces and can be either centered within the tubing or spaced apart from the center of the tubing. The present invention also defines an induction coil and an induction furnace having an induction coil which utilizes such tubing. The curved outer surface has a radius of curvature which is defined substantially by a function of the tubing width in the axial direction, and spacing between turns of the induction coil. The cross section of the outer surface of the outer peripheral portion of the tubing taken along a transverse axis of the tubing defines a geometric figure. The perimeter of the figure is substantially polygonal with at least one curved side wall.

67 Claims, 3 Drawing Sheets

TUBING SHAPE, PARTICULARLY FOR FABRICATING AN INDUCTION COIL

FIELD OF THE INVENTION

This invention relates to conductive tubing having a special shape and, more particularly, to the use of such tubing for fabricating an induction coil. The conductive tubing has an outer surface having at least one curved side wall. The invention is described in the context of, but is not limited to, induction heating apparatus.

BACKGROUND OF THE INVENTION

Induction heating apparatus such as induction furnaces for heating or melting metals operate on the principle of inducing eddy currents in a workpiece (sometimes referred to as the load) to be heated. The eddy currents cause the load to act as its own heat source by the $P=I^2R$ heating principle. The eddy currents are induced in the load by passing alternating current through a generally helical induction coil disposed near or around the load.

Induction furnaces in common use today include induction coils of copper tubing adapted to allow a liquid coolant to flow therethrough. The copper tubing conducts the alternating current which produces the electromagnetic field inside the furnace to create the eddy currents in the load. Running water or other liquid coolant flows through the copper tubing of the coil to remove the heat conducted through the refractory material and the heat generated by the coil current.

The efficiency of an induction furnace depends, in part, on the amount of energy (in the form of electromagnetic energy) which couples from the induction coil to the load and is converted into heat energy in the load. One overall goal in designing such furnaces is to maximize this efficiency. The efficiency is a function of many different design parameters. One parameter which affects the efficiency is the tubing used to fabricate the induction coil. Different tubing shapes, sizes and dimensions, when wound into a helical induction coil, will produce different electromagnetic flux patterns. Different patterns will cause more or less of the electromagnetic energy to couple into the load, thereby resulting in greater or lesser furnace efficiency.

In the prior art, the induction coil tubing typically has a rectangular cross-sectional profile with a rectangular or round opening for cooling fluid to flow therethrough. The outer side walls of the rectangular tubing are typically straight, although sometimes the outer corners may be slightly rounded. Another well-known form of tubing has a circular cross-sectional profile with a circular opening therethrough. Oval-shaped tubing with an oval-shaped opening therethrough is also well-known.

One prior art attempt to increase the efficiency of an induction coil by changing the geometry of the tubing involved displacing the opening of the tubing away from the center axis of the tubing. In other words, instead of the geometric center of the opening being centered on the center axis of the tubing, the geometric center of the opening was spaced apart from the center axis. This displacement resulted in a reduction of losses due to a decreased amount of energy lost in the tubing.

In spite of extensive research and exhaustive attempts to further improve the efficiency of induction melting furnaces, there is still a need for further improvements in efficiency of an induction coil so as to maximize the proportion of energy supplied to the induction coil which couples to the load and heats it through induced eddy currents. Specifically, there is a need for further improvements in the shape of the tubing used in the induction coil which will lead to higher efficiencies. The present invention fills that need.

SUMMARY OF THE INVENTION

In one embodiment, the present invention defines an electrically conductive tubing for realizing induction coils having improved efficiencies wherein the tubing comprises an outer peripheral portion of conductive material defined by a plurality of side walls and a single hollow passageway. Each side wall has an inner and outer surface. At least one side wall has a curved outer surface. The hollow passageway is defined by the inner surfaces and can be either centered within the tubing or spaced apart from the center of the tubing. The present invention also defines an induction coil and an induction furnace having an induction coil which utilizes such tubing. The curve of the tubing side wall has a radius of curvature which is substantially a function of the tubing width in the axial direction, and spacing between turns of the induction coil.

In another embodiment, the invention defines electrically conductive tubing for realizing induction coils having improved efficiencies wherein the tubing comprises an outer peripheral portion of conductive material defined by four side walls and a single hollow passageway. Each side wall has an inner and outer surface, and ends. The first and second side walls are substantially parallel to one another and meet at one of their respective ends a third side wall perpendicular thereto. A fourth side wall meets the other ends of the parallel side walls and has a curved outer surface. The hollow passageway is defined by the inner surfaces. The present invention also defines an induction coil and an induction furnace having an induction coil which utilizes such tubing.

In still another embodiment, the invention defines electrically conductive tubing for realizing induction coils having improved efficiencies wherein the tubing comprises an outer peripheral portion of conductive material and a single hollow passageway. The outer peripheral portion is a closed form and is defined by at least one pair of adjacent and perpendicularly disposed straight side walls. At least one side wall is curved. The hollow passageway is defined by the inner surfaces. The present invention also defines an induction coil and an induction furnace including an induction coil which utilizes such tubing.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

While the invention will be described in connection with presently preferred embodiments, it will be understood that it is not intended to limit the invention to any one disclosed embodiment. On the contrary, it is intended to cover all alternatives, modifications and equivalents as may be included within the spirit and scope of the invention as defined by the appended claims.

Figure 1:
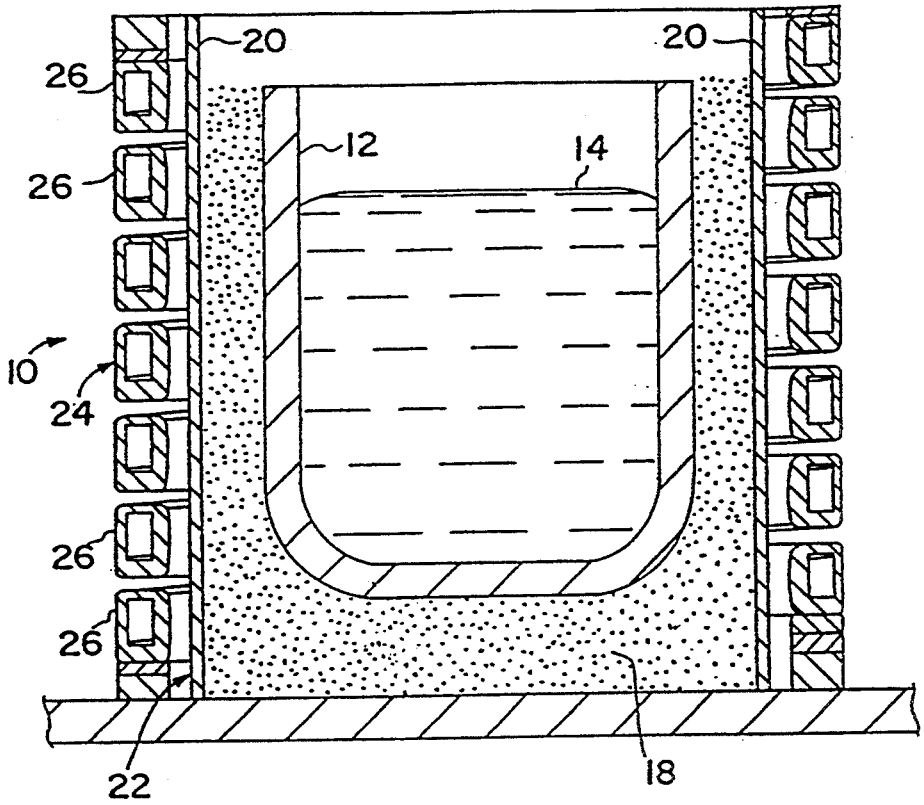
FIG. 1 is a cross-section of an induction melting furnace which shows an induction coil fabricated from the novel tubing according to the present invention.

Referring now to the drawings, wherein like numerals indicate like elements, there is shown in FIG. 1 selected components of an induction melting furnace 10 which are visible in cross-section. Only those elements of an induction furnace necessary to illustrate the present invention have been shown, and the rest have been omitted for the sake of clarity. Those skilled in the art will have no difficulty in understanding the invention from the simplified illustrations and the accompanying description.

Furnace 10 comprises a crucible 12 which holds a workpiece or load 14. Load 14 typically consists of a conductive material such as metal but can also comprise nonmetallic conductive materials. The crucible 12 is surrounded by rammed refractory 18, which is packed around the crucible 12. The rammed refractory 18 may in turn be surrounded by a shell 20 which gives added mechanical strength to furnace 10. For explanation purposes, the combination of the crucible 12, rammed refractory 18 and shell 20 are referred hereinafter as assembly 22.

An induction coil 24 surrounds the entire assembly 22. The induction coil 24 is formed from conductive tubing 26 wound in a helical coil. The simplified view in FIG. 1 depicts seven windings (sometimes called "turns") of tubing for illustration purposes. However, it should be understood that the invention is not limited to any particular number of windings but, rather, encompasses any number of windings as may be desired for a particular coil.

Figure 2:
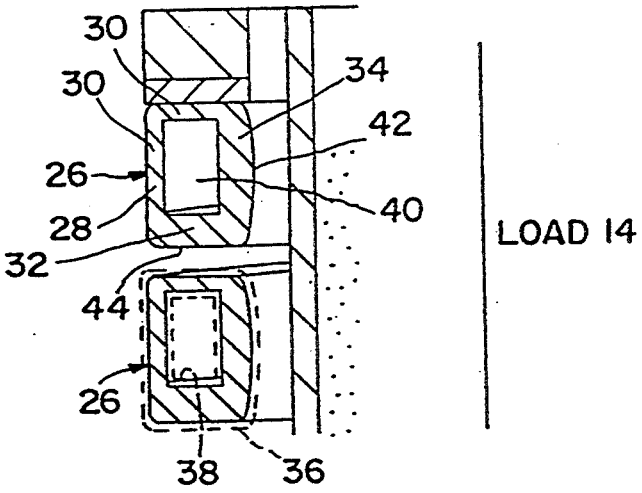
FIG. 2 is an enlarged fragmentary of FIG. 1, showing geometric features of the tubing in greater detail.

FIG. 2 is an enlarged fragmentary view of FIG. 1 and illustrates the novel aspects of the tubing shape. The tubing 26 in FIG. 2 is defined by an outer peripheral portion 28 defined by a plurality of side walls 30, 32 and 34, each of which has an inner surface and an outer surface. The outer surfaces can be either planar or nonplanar, i.e., curved. The outer surfaces of the side walls define the outer perimeter 36 (shown as a dotted line surrounding the lowermost turn of tubing 26) which is substantially polygonal. That is, tubing 26 has a substantially polygonal cross-section when taken along a transverse axis of the tubing 26, except for one side which is curved as described below. The inner surfaces of the side walls define inner perimeter 38 (also shown as a dotted line surrounding the lowermost turn of tubing 26) which is also substantially polygonal in cross-section. The inner perimeter 38 defines the dimensions of opening 40, through which coolant fluid flows. In the exemplary embodiment, the polygon is a rectangle. However, the invention is not limited only to rectangular polygonal shapes.

One novel feature of the invention is that the tubing 26 comprising the induction coil 24 is shaped such that at least one of its side walls (denoted in FIG. 2 as 30, 32 and 34) which faces the load 14 has a curved outer surface. In the embodiment depicted in FIG. 2, side wall 34 which faces load 14 has a curved outer surface 42. Alternatively, two adjacent side walls can have curved outer surfaces. For example, FIG. 2 depicts adjacent side walls 34 and 32 having curved outer surfaces 42 and 44, respectively. However, it is a novel feature of the invention that at least the side wall facing the load 14 has a curved outer surface.

It should be understood that the windings of tubing 26 depicted in cross-section in FIG. 1 are typically, but not necessarily, part of a continuous piece of tubing. Thus, the induction coil can be fabricated by using tubing with one side wall having a curved outer surface and winding the tubing into a coil while always keeping the curved outer surface 42 facing inward (toward the center axis of the coil 24).

Another novel feature of the invention is that tubing 26 having at least one side wall with a curved outer surface 42 facing the load 14 has an internal opening 40 displaced from the center axis of tubing 26. In the exemplary embodiment depicted in FIG. 2, tubing 26 has an opening 40 with a substantially polygonal cross-section taken along the transverse axis of the tubing. Instead of the geometric center of the opening 40 being centered on the center axis of the tubing 26, the geometric center of the opening 40 is spaced apart (or displaced) from the center axis. As noted above, this displacement results in a reduction of losses from the coil 24 because of increased coupling of electromagnetic flux to the load 14 when compared to tubing in which the opening 40 is centered on the center axis of tubing 26.

Figure 3:
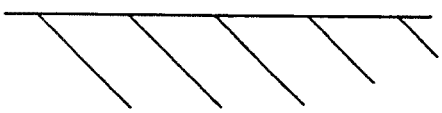
FIG. 3 is an enlarged fragmentary view of an alternative embodiment of the tubing shown in FIG. 1.

FIG. 3 illustrates an enlarged view of an alternative embodiment of the tubing 26 shown in FIG. 1. Focusing on the uppermost turn of tubing 26, outer perimeter 36 of the outer peripheral portion 28 of tubing 26 which is defined by three side walls 30 and one side wall 34 has a substantially polygonal cross-section when taken along the transverse axis of the tubing, except for side wall 34 whose outer surface is curved. Inner perimeter 38 of the outer peripheral portion 28 also has a substantially polygonal cross-section when taken along the transverse axis of the tubing 26. The inner perimeter 38 defines the dimensions-of opening 40. In the exemplary embodiment, the polygon is a rectangle, and more particularly, a square. However, the invention is not limited only to rectangular polygonal shapes.

In the FIG. 3 embodiment, the geometric center of the opening 40 is centered within the tubing 26, as is common in the prior art. Most importantly with respect to FIG. 3, the curved side wall 34 faces assembly 22, thereby also facing load 14 (not shown).

FIG. 3 also illustrates a lowermost tube 46 forming the bottom turn of induction coil 24 which has two adjacent curved side walls, one of which faces the load 14 (not shown). Tube 46 also has a center opening displaced from the transverse axis of the tube. One advantage of having a curvature on two adjacent side walls in combination with a displaced opening is that the same generally rectangular piece of tubing can be wound in either of two directions depending on the coil spacing. By carefully selecting the dimensions of the substantially rectangular tubing, one would need to stock only one-half as many shapes of tubing.

Figure 4:
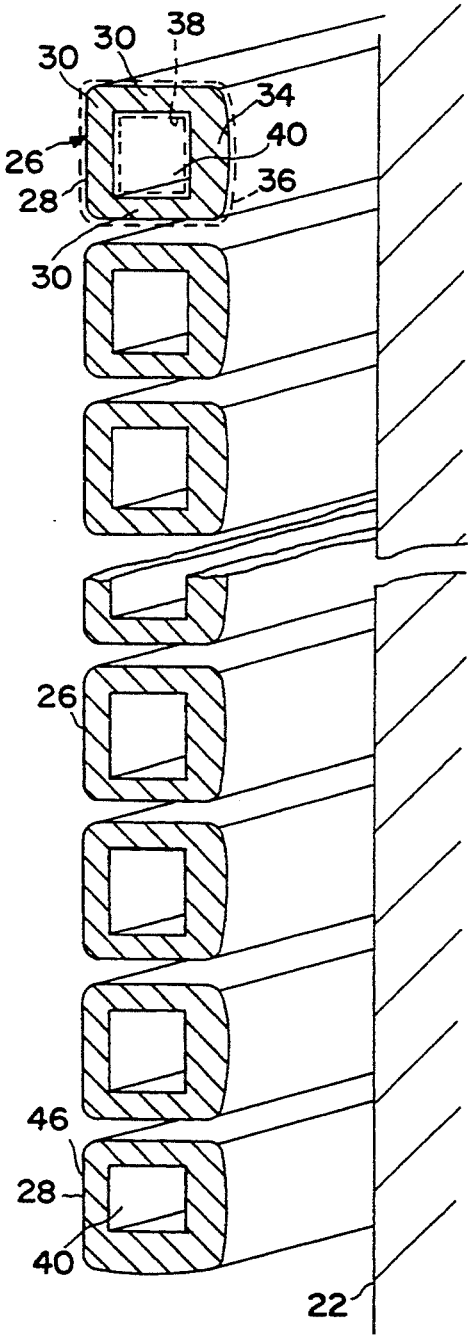
FIG. 4 is an enlarged fragmentary view of another alternative embodiment of the tubing shown in FIG. 1.
Figure 4:
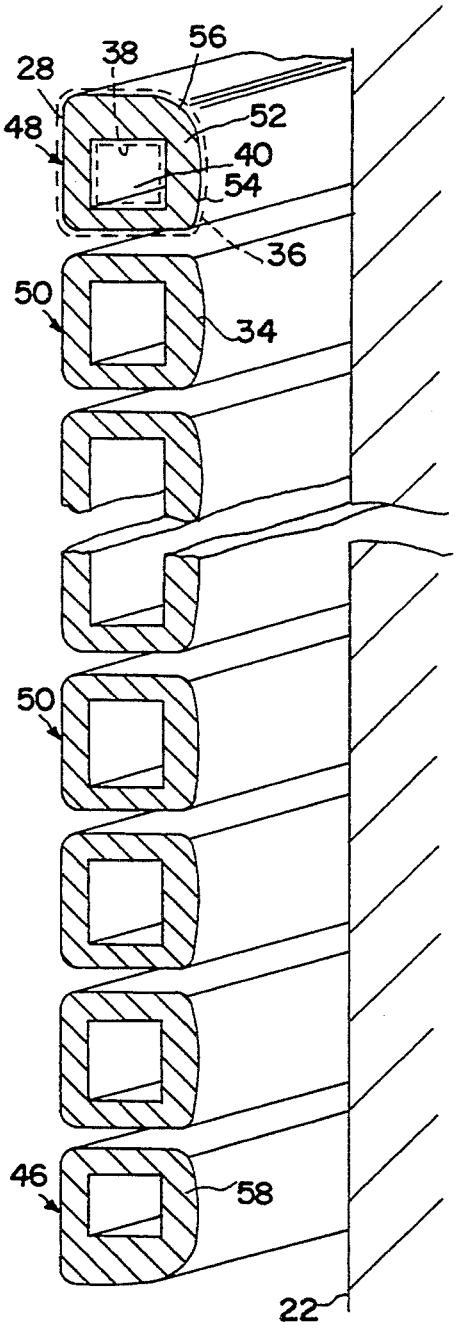

FIG. 4 illustrates yet another embodiment of the invention wherein uppermost tube 48 which forms the coil's top turn and lowermost tube 46 which forms the coil's bottom turn have a geometric shape which is different from the tubes of intermediate turns 50. The tubes of intermediate turns 50 are similar in geometric shape to the tubes 26 described with respect to FIG. 3. The uppermost tube 48 has an outer peripheral portion 28. Outer perimeter 36 of this peripheral portion 28 has a substantially polygonal cross-section when taken along the transverse axis of the tubing 28, except for one side wall 52 which has at least one curve or curvature with an exaggerated or high degree of curvature. In contrast, curved side wall 34 of the tubes of intermediate turns 50 preferably has only one curvature. Referring again to uppermost tube 48, inner perimeter 38 of the outer peripheral portion 28 has a substantially polygonal cross-section when taken along the transverse axis of the tubing 28. The inner perimeter 38 defines the dimensions of opening 40. In this exemplary embodiment, the polygon is a rectangle.

As noted above, the side wall 52 is defined by at least one curve having an exaggerated or high degree of curvature. In the exemplary embodiment, the side wall 52 is defined by at least two different adjacent curvatures, one of which is exaggerated with respect to the other. More specifically, the depicted curve has a first portion 54 with a gradual curvature followed by a second portion 56 with an exaggerated or high degree of curvature. It should also be recognized that side wall 52 can also be defined by a single curve having an exaggerated or high degree of curvature.

FIG. 4 also depicts lowermost tube 46 which forms the coil's bottom turn. This tube 46 has a curved side wall 58 whose shape is a mirror image of side wall 52.

Again, all of the side walls 30 of the tubes in FIG. 4 which either directly or partially face assembly 22, and which thereby also directly or partially face load 14 (not shown), have a curvature.

FIG. 4 requires the use of a different geometric shape for the tubing which forms the top and bottom end turns. However, in certain applications, the increased efficiency gained by the exaggerated or high degree of curvature at the ends may offset the disadvantages associated with using the two different shapes to form the coil.

The curves or curvatures referred to above are mathematically defined by the inverse of the curvature, called the "radius of curvature," R. The radius of curvature, R, is a function of the tubing width, w, in the axial direction and the spacing between turns, x, of the induction coil. Mathematically, this can be expressed as:

$$R=f(w, x)$$

Figure 5:
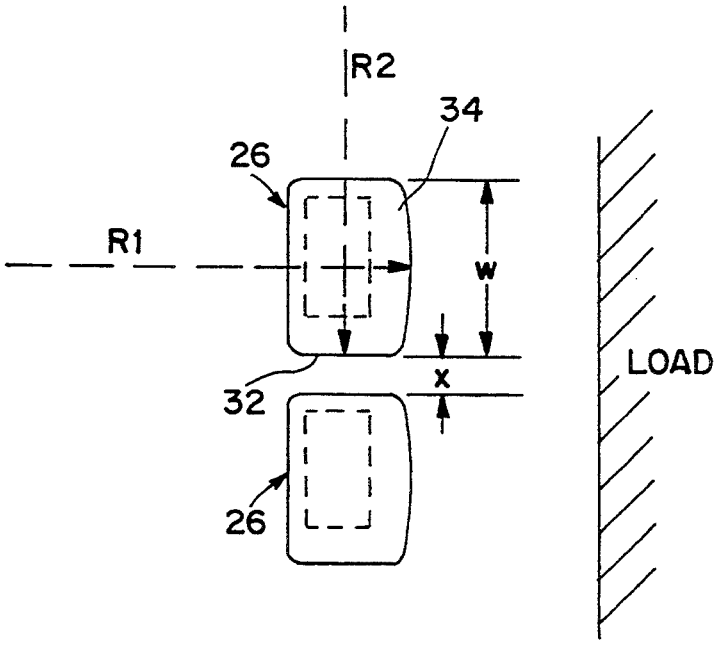
FIG. 5 is an enlarged view of two adjacent turns of the induction coil shown in FIG. 1, illustrating dimensions used for determining the radius of curvature of the curved side walls.

This is best illustrated with respect to FIG. 5 which is an exaggerated view of two adjacent portions of tubing 26 generally depicted in FIGS. 1 and 2. The radius of curvature of side wall 34 facing the load, labelled as R1, is a function of the tubing width, w, in the axial direction and the spacing between adjacent turns of the coil, represented as x in a cross-section of the coil. The radius of curvature of adjacent side wall 32, labelled as R2, is preferably, but not necessarily equal to R1.

Geometrically speaking, the curvature of a space curve, at a point on a curve is the derivative of the inclination of the tangent with respect to arc length, also expressed as the rate of change of direction of the tangent with respect to the are length, i.e., $$K=d\theta/ds,$$

where K is the curvature, $\theta$ represents the change in direction of the tangent, and s is the length. The radius of curvature, R, can then be expressed as the inverse of that function, or the inverse of K.

In one design example using copper tubing, the tubing width, w, is $\frac{3}{8}$ of an inch and the spacing between adjacent turns of the coil, x, is $\frac{3}{8}$ of an inch, yielding a radius of curvature of $4\frac{1}{2}$ inches. When tubing having these dimensions were used to form a coil with a single curved side wall facing the load, losses in coil conductors were decreased by 8% in comparison with identically shaped tubing not having a curvature.

Opening 40 in the variously shaped tubes is depicted in the preferred embodiments as being substantially rectangular. However, it should be understood that the opening can be any geometric shape that achieves the desired function of acting as a cooling channel.

The disclosed embodiments all depict outer peripheral portions with polygonal cross-sectional shapes. However, it should be understood that the ends of adjacent side walls need not necessarily meet one another exactly at the ends. One end may overlap an adjacent end so as to stick out from the adjacent end when viewed in cross-section.

The novel tubing shape for induction coils described above provides significant advantages not contemplated by the prior art. By merely altering the geometric shape of a portion of the tubing, induction heating furnaces with greater efficiencies can now be constructed. This greater efficiency allows one to achieve either faster heating of the load with the same input of electrical energy and cooling energy into the induction coil, or the same amount of heating of the load but with less electrical energy and/or cooling energy input into the induction coil.

The present invention may be embodied in other specific forms without departing from the spirit or essential attributes thereof and, accordingly, reference should be made to the appended claims, rather than to the foregoing specification, as indicating the scope of the invention.

We claim:

1. Electrically conductive tubing for realizing induction coils having improved efficiencies, the tubing comprising:

(a) an outer peripheral portion of conductive material defined by a plurality of side walls, each side wall having inner and outer surfaces, at least one of said plurality of side walls having a curved outer surface, said at least one of said plurality of side walls having a non-uniform thickness between the curved outer surface and the inner surface of said side wall, and at least one other of said side walls having a straight outer surface; and (b) a single hollow passageway defined by the inner surfaces.

2. Electrically conductive tubing according to claim 1, wherein the cross section of the outer surface of the outer peripheral portion of the tubing taken along a transverse axis of the tubing defines a geometric figure, the perimeter of the figure being substantially polygonal with at least one side wall being curved and at least one side wall being straight.

3. Electrically conductive tubing according to claim 2, wherein the polygon is a quadrilateral having three straight side walls and one curved side wall.

4. Electrically conductive tubing according to claim 3, wherein the quadrilateral is a rectangle with three straight side walls and one curved side wall.

5. Electrically conductive tubing according to claim 4, wherein the rectangle is a square with three straight side walls and one curved side wall.

6. Electrically conductive tubing according to claim 2, wherein the remaining side walls are substantially straight.

7. Electrically conductive tubing according to claim 1, wherein at least two adjacent side walls have a curved outer surface.

8. Electrically conductive tubing according to claim 7, wherein the remaining two outer surfaces are substantially straight.

9. Electrically conductive tubing according to claim 1, wherein the cross section of the hollow passageway of the tubing taken along a transverse axis of the tubing is substantially polygonal.

10. Electrically conductive tubing according to claim 9 wherein the polygon is a rectangle.

11. Electrically conductive tubing according to claim 1 wherein at least two sets of adjacent side walls are perpendicular to one another.

12. Electrically conductive tubing according to claim 1, wherein the geometric center of the hollow passageway is spaced apart from the center of the tubing.

13. Electrically conductive tubing according to claim 1, wherein the geometric center of the hollow passageway is generally centered within the tubing.

14. Electrically conductive tubing according to claim 1, wherein the conductive material is solid copper.

15. Electrically conductive tubing for realizing induction coils having improved efficiencies, the tubing comprising:

(a) an outer peripheral portion of conductive material defined by four side walls, each side wall having an inner and outer surface, and ends, first and second side walls being substantially parallel to one another, and meeting at one of their respective ends a third side wall perpendicular thereto, a fourth side wall meeting the other ends of the parallel side walls and having a curved outer surface, the fourth side wall having a non-uniform thickness between the curved outer surface and the inner surface of said side wall; and (b) a single hollow passageway defined by the inner surfaces.

16. Electrically conductive tubing according to claim 15, wherein tile cross section of the outer surface of the outer peripheral portion of the tubing taken along a transverse axis of the tubing defines a geometric figure, the perimeter of the figure being substantially polygonal with at least one curved side wall.

17. Electrically conductive tubing according to claim 16, wherein tile polygon is a rectangle with three straight side walls and one curved side wall.

18. Electrically conductive tubing according to claim 15, wherein the lengths of the first and second side walls are different.

19. Electrically conductive tubing according to claim 15, wherein one side wall adjacent to tile fourth side wall has a curved outer surface.

20. Electrically conductive tubing according to claim 15, wherein the geometric center of the hollow passageway is spaced apart from the center of the tubing.

21. Electrically conductive tubing according to claim 15, wherein the first, second, and third sides are substantially straight.

22. Electrically conductive tubing for realizing induction coils having improved efficiencies, the tubing having inner and outer surfaces, the tubing comprising:

(a) an outer peripheral portion of conductive material defined by (i) at least one pair of adjacent and perpendicularly disposed straight side walls, and (ii) at least one side wall having a curved outer surface, said side wall having a non-uniform thickness between the curved outer surface and the inner surface of said side wall, the outer peripheral portion being a closed form; and (b) a single hollow passageway defined by the inner surfaces.

23. Electrically conductive tubing according to claim 22, wherein the outer peripheral portion of the tubing has an outer surface, the cross section of the outer surface taken along a transverse axis of the tubing defining a geometric figure, the perimeter of the figure being substantially polygonal with at least one curved side wall.

24. Electrically conductive tubing according to claim 23, wherein the polygon is a rectangle with three straight side walls and one curved side wall.

25. Electrically conductive tubing according to claim 22, wherein at least two adjacent side walls have a curved outer surface.

26. Electrically conductive tubing according to claim 22, wherein the geometric center of the hollow passageway is spaced apart from the center of the tubing.

27. An induction coil for induction heating wherein the turns of the induction coil are constructed of electrically conductive tubing having improved efficiencies, the induction coil having a center axis, the tubing comprising:

(a) an outer peripheral portion of conductive material defined by four side walls, each side wall having an inner and outer surface, and ends, first and second side walls being substantially straight, parallel to one another, and meeting at one of their ends a substantially straight third side wall perpendicular thereto, the fourth side wall meeting the other ends of the parallel side walls and having a curved outer surface, the fourth side wall facing the axis of the coil; and (b) a single hollow passageway defined by the inner surfaces for passing a cooling medium therethrough.

28. An induction coil according to claim 27, wherein the lengths of the first and second side walls are different.

29. An induction coil according to claim 27, wherein the tubing has a preselected width in a direction along the axis of the coil, the curved fourth side wall having a radius of curvature which is substantially a function of (i) the tubing preselected width in the axial direction, and (ii) spacing between turns of the induction coil.

30. An induction coil according to claim 27, wherein the cross section of the outer surface of the outer peripheral portion of the tubing taken along a transverse axis of the tubing defines a geometric figure, the perimeter of the figure being substantially polygonal with at least one curved side wall.

31. An induction coil according to claim 30, wherein the polygon is a rectangle with three straight side walls and one curved side wall.

32. An induction coil according to claim 27, wherein at least two adjacent side walls have a curved outer surface.

33. An induction coil according to claim 27, wherein the geometric center of the hollow passageway is spaced apart from the center of the tubing.

34. An induction coil fabricated from tubing which forms turns of the induction coil, the induction coil having a preselected width in an axial direction and a center axis, the tubing comprising:

(a) an outer peripheral portion of conductive material defined by a plurality of side walls, each side wall having an inner and outer surface, at least one of said plurality of side walls having a curved outer surface, at least one other of said plurality of side walls having a straight outer surface, the curve of the outer surface having a radius of curvature which is substantially a function of (i) the tubing preselected width in the axial direction, and (ii) spacing between turns of the induction coil, said side wall facing the axis of the coil; and (b) a single hollow passageway defined by the inner surfaces.

35. An induction coil according to claim 34, wherein the cross section of the outer surface of the outer peripheral portion of the tubing taken along a transverse axis of the tubing defines a geometric figure, the perimeter of the figure being substantially polygonal with at least one side wall being curved and at least one side wall being straight.

36. An induction coil according to claim 35, wherein the polygon is a rectangle with three straight side walls and one curved side wall.

37. An induction coil according to claim 34, wherein at least two adjacent side walls have a curved outer surface.

38. An induction coil according to claim 34, wherein the geometric center of the hollow passageway is spaced apart from the center of the tubing.

39. An induction coil fabricated from tubing which forms turns of the induction coil, the induction coil having a preselected width in an axial direction and a center axis, the tubing comprising:

(a) an outer peripheral portion of conductive material defined by four side walls, each side wall having an inner and outer surface, and ends, first and second side walls being substantially parallel to one another, and meeting at one of their respective ends a third side wall perpendicular thereto, a fourth side wall meeting the other ends of the parallel side walls and having a curved outer surface, the curved outer surface having a radius of curvature which is substantially a function of (i) the tubing preselected width in the axial direction, and (ii) spacing between turns of the induction coil, said fourth side wall facing the axis of the coil; and (b) a single hollow passageway defined by the inner surfaces.

40. An induction coil according to claim 39, wherein the lengths of the first and second side walls are different.

41. An induction coil according to claim 39, wherein the cross section of the outer surface of the outer peripheral portion of the tubing taken along a transverse axis of the tubing defines a geometric figure, the perimeter of the figure being substantially polygonal with at least one curved side wall.

42. An induction coil according to claim 41, wherein the polygon is a rectangle with three straight side walls and one curved side wall.

43. An induction coil according to claim 39, wherein one side wall adjacent to the fourth side wall has a curved outer surface.

44. An induction coil according to claim 39, wherein the geometric center of the hollow passageway is spaced apart from the center of the tubing.

45. An induction coil according to claim 39, wherein the first, second, and third sides are substantially straight.

46. An induction coil fabricated from tubing which forms turns of the induction coil, the induction coil having a preselected width in an axial direction and a center axis, the tubing comprising:

(a) an outer peripheral portion of conductive material defined by (i) at least one pair of adjacent and perpendicularly disposed straight side walls, and (ii) at least one curved side wall facing the axis of the coil, the outer peripheral portion being a closed form, each side wall having outer and inner surfaces, the curve of the side wall having a radius of curvature defined substantially by a function of (A) the tubing width in the axial direction, and (B) spacing between turns of the induction coil; and (b) a single hollow passageway defined by the inner surfaces.

47. An induction coil according to claim 46, wherein the outer peripheral portion of the tubing has an outer surface, the cross section of the outer surface taken along a transverse axis of the tubing defining a geometric figure, the perimeter of the figure being substantially polygonal with at least one curved side wall.

48. An induction coil according to claim 47, wherein the polygon is a rectangle with three straight side walls and one curved side wall.

49. An induction coil according to claim 46, wherein at least two adjacent side walls have a curved outer surface.

50. An induction coil according to claim 46, wherein the geometric center of the hollow passageway is spaced apart from the center of the tubing.

51. An induction furnace including an induction coil for applying heat energy to a load which is at least partially surrounded by turns of the induction coil by inducing eddy currents in the load, the induction coil being fabricated from tubing which forms said turns of the induction coil, the tubing comprising:

(a) an outer peripheral portion of conductive material defined by a plurality of side walls, each side wall having an inner and outer surface, at least one of said plurality of side walls having a curved outer surface and at least partially facing the load, at least one other of said plurality of side walls having a straight outer surface; and (b) a single hollow passageway defined by the inner surfaces.

52. An induction furnace according to claim 51, wherein the cross section of the outer surface of the outer peripheral portion of the tubing taken along a transverse axis of the tubing defines a geometric figure, the perimeter of the figure being substantially polygonal with at least one side wall being curved and at least one side wall being straight.

53. An induction furnace according to claim 52, wherein the polygon is a rectangle with three straight side, walls and one curved side wall.

54. An induction furnace according to claim 51, wherein at least two adjacent side walls have a curved outer surface.

55. An induction furnace according to claim 51, wherein the geometric center of the hollow passageway is spaced apart from the center of the tubing.

56. An induction furnace including an induction coil for applying heat energy to a load which is at least partially surrounded by turns of the induction coil by inducing eddy currents in the load, the induction coil being fabricated from tubing which forms said turns of the induction coil, the tubing comprising:

(a) an outer peripheral portion of conductive material defined by four side walls, each side wall having an inner and outer surface, and ends, first and second side walls being substantially parallel to one another, and meeting at one of their respective ends a third side wall perpendicular thereto, a fourth side wall meeting the other ends of the parallel side walls and having a curved outer surface, the fourth side wall at least partially facing the load; and (b) a single hollow passageway defined by the inner surfaces.

57. An induction furnace according to claim 56, wherein the lengths of the first and second side walls are different.

58. An induction furnace according to claim 56, wherein the cross section of the outer surface of the outer peripheral portion of the tubing taken along a transverse axis of the tubing defines a geometric figure, the perimeter of the figure being substantially polygonal with at least one curved side wall.

59. An induction furnace according to claim 58, wherein the polygon is a rectangle with three straight side walls and one curved side wall.

60. An induction furnace according to claim 56, wherein one side wall adjacent to the fourth side wall has a curved outer surface.

61. An induction furnace according to claim 56, wherein the geometric center of the hollow passageway is spaced apart from the center of the tubing.

62. An induction furnace according to claim 56, wherein the first, second, and third sides are substantially straight.

63. An induction furnace including an induction coil for applying heat energy to a load which is at least partially surrounded by turns of the induction coil by inducing eddy currents in the load, the induction coil being fabricated from tubing which forms said turns of the induction coil, the tubing comprising:

(a) an outer peripheral portion of conductive material defined by (i) at least one pair of adjacent and perpendicularly disposed straight side walls, and (ii) at least one curved side wall at least partially facing the load, the outer peripheral portion being a closed form; and (b) a single hollow passageway defined by the inner surfaces.

64. An induction furnace according to claim 63, wherein the outer peripheral portion of the tubing has an outer surface, the cross section of the outer surface taken along a transverse axis of the tubing defining a geometric figure, the perimeter of the figure being substantially polygonal with at least one curved side wall.

65. An induction furnace according to claim 64, wherein the polygon is a rectangle with three straight side walls and one curved side wall.

66. An induction furnace according to claim 63, wherein at least two adjacent side walls have a curved outer surface.

67. An induction furnace according to claim 63, wherein the geometric center of the hollow passageway is spaced apart from the center of the tubing.

* * * * *

UNITED STATES PATENT AND TRADEMARK OFFICE

CERTIFICATE OF CORRECTION

PATENT NO. : 5,446,269

DATED : August 29, 1995

INVENTOR(S) : Vitaly Peysakhovich, et. al.

It is certified that error appears in the above-indentified patent and that said Letters Patent is hereby corrected as shown below:

Title page, item[75] Inventors: should read --Vitaly Peysakhorich, Moorestown, NJ; Oleg S. Fishman, Maple Glen, PA; and Satyen N. Prabhu, Voorhees, NJ--

Signed and Sealed this

Twelfth Day of December, 1995

*Attest:*

*Attesting Officer*

BRUCE LEHMAN

*Commissioner of Patents and Trademarks*